US008350650B2

(12) United States Patent
Rajula

(10) Patent No.: US 8,350,650 B2
(45) Date of Patent: Jan. 8, 2013

(54) QUADRUPOLE MAGNETIC CODED SWITCH

(75) Inventor: Gangi Reddy Rajula, Andhrapradesh (IN)

(73) Assignee: Honeywell International Inc., Morristown, NJ (US)

( * ) Notice: Subject to any disclaimer, the term of this patent is extended or adjusted under 35 U.S.C. 154(b) by 224 days.

(21) Appl. No.: 12/787,155

(22) Filed: May 25, 2010

(65) Prior Publication Data

US 2011/0291778 A1 Dec. 1, 2011

(51) Int. Cl.
*H01H 9/00* (2006.01)

(52) U.S. Cl. ..... 335/207; 335/205

(58) Field of Classification Search ..... 335/205–207
See application file for complete search history.

(56) References Cited

U.S. PATENT DOCUMENTS

| | | | | |
|---|---|---|---|---|
| 2,912,540 | A | 11/1959 | Sawicki | |
| 4,039,985 | A * | 8/1977 | Shlesinger et al. | 335/153 |
| 4,186,362 | A | 1/1980 | Kondo et al. | |
| 4,210,889 | A | 7/1980 | Holce | |
| 4,331,013 | A | 5/1982 | Jaulmes | |
| 4,438,430 | A | 3/1984 | Young et al. | |
| 4,812,674 | A * | 3/1989 | Sue et al. | 307/116 |
| 4,943,791 | A | 7/1990 | Holce et al. | |
| 4,945,340 | A | 7/1990 | Brill | |
| 5,233,322 | A | 8/1993 | Posey | |
| 5,233,323 | A | 8/1993 | Burkett et al. | |
| 5,239,202 | A | 8/1993 | Hostetler | |
| 5,293,523 | A | 3/1994 | Posey | |
| 5,633,626 | A | 5/1997 | Cawthorne | |
| 5,929,731 | A * | 7/1999 | Jackson, Jr. | 335/207 |
| 6,348,861 | B1 | 2/2002 | Li | |
| 6,963,281 | B2 * | 11/2005 | Buckley | 340/547 |
| 7,019,607 | B2 | 3/2006 | Busch | |
| 7,782,163 | B2 * | 8/2010 | Schmid et al. | 335/207 |
| 7,999,644 | B2 * | 8/2011 | Nakayama et al. | 335/207 |

* cited by examiner

*Primary Examiner* — Bernard Rojas
(74) *Attorney, Agent, or Firm* — Ingrassia Fisher & Lorenz, P.C.

(57) ABSTRACT

A quadrupole magnetic coded switch includes a switch housing, an actuator, one or more switch dipole magnets, and a plurality of magnetically operated switch circuits. The actuator housing is movable relative to the switch housing. The plurality of actuator dipole magnets are coupled to the actuator housing and are movable therewith. The one or more switch dipole magnets are coupled to the switch housing. The one or more switch dipole magnets and the plurality of actuator dipole magnets are arranged to generate a quadrupole magnetic field. Each magnetically operated switch circuit is disposed within the switch housing and is configured to transition between a plurality of switch positions in response to relative movement of the actuator housing and the switch housing.

17 Claims, 8 Drawing Sheets

QUADRUPOLE MAGNETIC CODED SWITCH

TECHNICAL FIELD

The present invention generally relates to magnetically operated switches, and more particularly relates to a quadrupole magnetic coded switch.

BACKGROUND

Various types of switches have been implemented to provide protection to both systems and personnel. Such switches, when provided, ensure that electrical power is available to at least certain portions of a system only when certain components are in predetermined positions with respect to each other. For example, one or more switches may be included in a system to ensure that separately driven parts of the system do not collide with each other.

Such switches may also be used to provide electrical power to energize one portion of a system only when a second portion is out of the path of a first portion. These switches may also be used to ensure that a machine or system operator is not within the vicinity of certain parts of a machine or system, such as in cutting, grinding, forging, or punching machines or systems, before power is made available to drive these parts.

The above-described switches have been variously implemented and configured. In many instances, these switches are mechanically or magnetically operated devices. While reliable, presently known mechanically and magnetically operated switches do exhibit certain drawbacks. For example, presently known mechanically and magnetically operated switches may be readily overridden by an operator in the interest of faster machine or system operation.

Hence there is a need for a tamper resistant switch and/or a switch that is not readily overridden, to ensure adequate levels of safety margin for machines and machine operators. The instant invention addresses at least this need.

BRIEF SUMMARY

In one embodiment, a quadrupole magnetic coded switch includes a switch housing, an actuator, one or more switch dipole magnets, and a plurality of magnetically operated switch circuits. The actuator housing is movable relative to the switch housing. The plurality of actuator dipole magnets are coupled to the actuator housing and are movable therewith. The one or more switch dipole magnets are coupled to the switch housing. The one or more switch dipole magnets and the plurality of actuator dipole magnets are arranged to generate a quadrupole magnetic field. Each magnetically operated switch circuit is disposed within the switch housing and is configured to transition between a plurality of switch positions in response to relative movement of the actuator housing and the switch housing.

In another embodiment, a quadrupole magnetic coded switch includes a switch housing, an actuator, one or more switch dipole magnets, and a plurality of reed switches. The actuator housing is movable relative to the switch housing. The plurality of actuator dipole magnets are coupled to the actuator housing and are movable therewith. The one or more switch dipole magnets are coupled to the switch housing. The one or more switch dipole magnets and the plurality of actuator dipole magnets are arranged to generate a quadrupole magnetic field. Each reed switch is disposed within the switch housing and is configured to transition between two switch positions when the actuator housing and switch housing are moved toward, and are within a first predetermined distance of, each other, and when the actuator housing and switch housing are moved away from, and are at least a second predetermined distance from, each other.

In yet another embodiment, a quadrupole magnetic coded switch includes a switch housing, an actuator, one or more switch dipole magnets, and a magnetically operated switch circuits. The actuator housing is movable relative to the switch housing. The plurality of actuator dipole magnets are coupled to the actuator housing and are movable therewith. The one or more switch dipole magnets are coupled to the switch housing. The one or more switch dipole magnets and the plurality of actuator dipole magnets are arranged to generate a quadrupole magnetic field. The magnetically operated switch circuit is disposed within the switch housing and is configured to move from an open position to a closed position when the actuator housing and switch housing are moved toward, and are within a first predetermined distance of, each other. The magnetically operated switch circuit is also configured to move from the closed position to the open position when the actuator housing and switch housing are the moved away from, and are at least a second predetermined distance from, each other. The first predetermined distance is less than the second predetermined distance.

Furthermore, other desirable features and characteristics of the present invention will become apparent from the subsequent detailed description, taken in conjunction with the accompanying drawings and this background.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
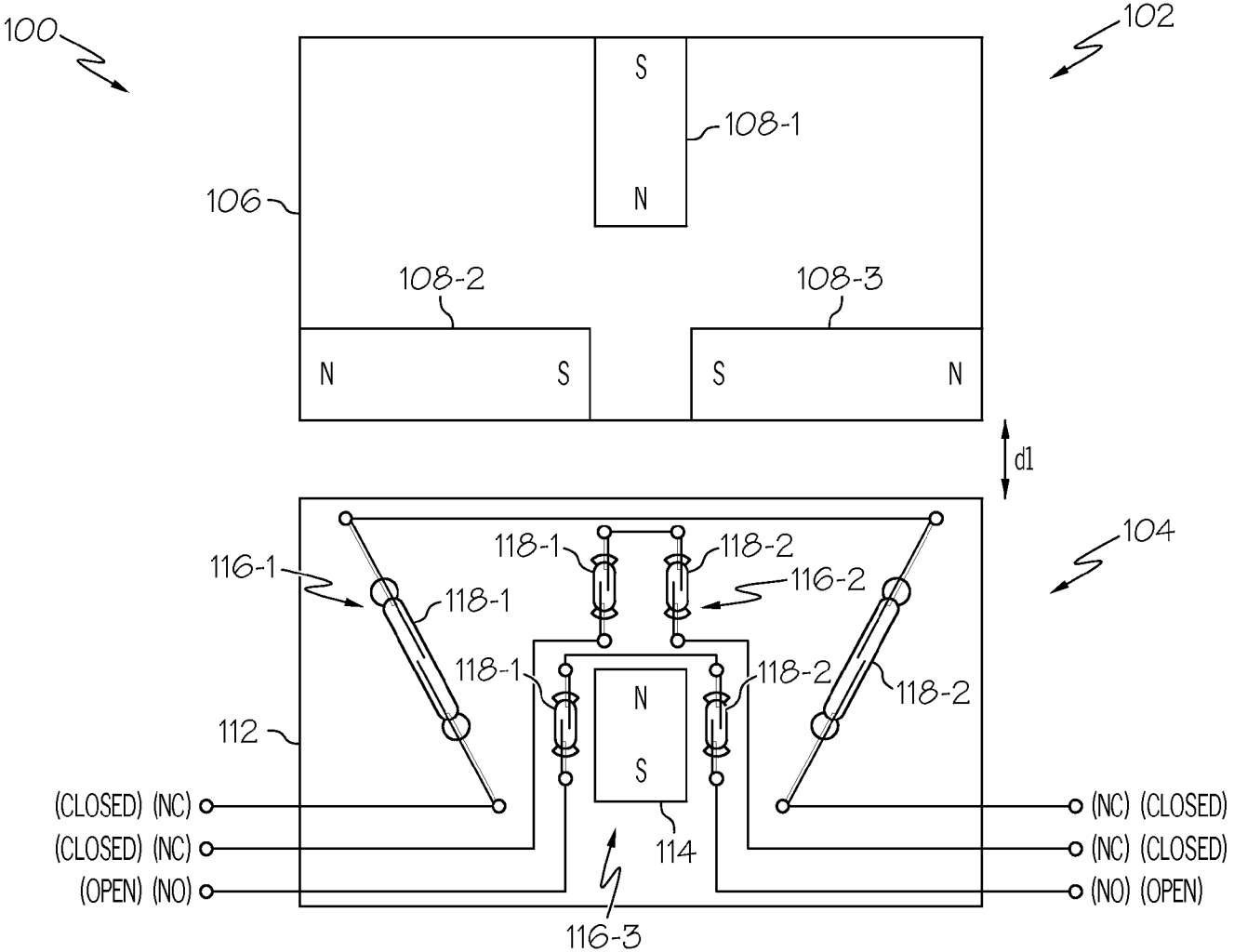
FIG. 1 depicts a functional schematic diagram of an embodiment of a quadrupole magnetic coded switch in a first state.

A functional schematic diagram of an embodiment of a quadrupole magnetic coded switch is depicted in FIG. 1. The switch 100 includes an actuator assembly 102 and a switch assembly 104. The actuator assembly 102 includes an actuator housing 106 and a plurality of dipole magnets 108, which are referred to herein as actuator dipole magnets. In the embodiment depicted in FIG. 1, the actuator assembly 102 includes three actuator dipole magnets 108 (e.g., 108-1, 108-2, 108-3). However, as will be described further below, in other embodiments the actuator assembly 102 could be implemented with less than this number of actuator dipole magnets 108. Moreover, although the actuator dipole magnets 108 are preferably implemented using permanent magnets, electromagnets could also be used.

The switch assembly 104 includes a switch housing 112, a dipole magnet 114, which is referred to herein as a switch dipole magnet, and a plurality of magnetically operated switch circuits 116. The switch dipole magnet 114 is coupled to the switch housing 112. As will also be described further below, the switch assembly 104 may, in other embodiments, include more than one switch dipole magnet 114. As with the actuator dipole magnets 108, although the switch dipole magnets 114 are preferably implemented using permanent magnets, electromagnets could also be used.

The magnetically operated switch circuits 116 are disposed within the switch housing 112 and, as will be described momentarily, are each configured to selectively transition between a plurality of switch positions in response to relative movement of the actuator housing 106 and the switch housing 112. The magnetically operated switch circuits 116, at least in the depicted embodiment, each include one or more sets of switch contacts 118 that are each movable between open states and closed states. Although the number of magnetically operated switch circuits 116 and associated sets of switch contacts 118 may vary, in the depicted embodiment the switch assembly 104 includes three switch circuits 116-1, 116-2, 116-3, with each magnetically operated switch circuit 116 having two sets of switch contacts 118-1, 118-2. It will be appreciated that the magnetically operated switch circuits 116 may be implemented using any one of numerous types of switches. For example, the magnetically operated switch circuits 116 may be implemented using various types and combinations of switches and sensor including, but not limited to, AMR (anisotropic magneto-resistance), GMR (giant magneto-resistance), Hall sensors, or reed switches, just to name a few. In the depicted embodiments, however, the magnetically operated switch circuits 116 are each implemented using a plurality of reed switches. In this regard, the particular configuration of reed switches that are used (e.g., Form A, Form B, Form C, etc.) may also vary.

No matter the specific number of actuator dipole magnets 108 and switch dipole magnets 114, the actuator dipole magnets 108 and switch dipole magnets 114 are arranged to generate a quadrupole magnetic field. Moreover, the magnetically operated switch circuits 116 are disposed in the switch housing 112 to transition between the plurality of switch positions based on the relative strength of the quadrupole magnetic field. In particular, the magnetically operated switch circuits 116 are configured to transition between the switch positions when the actuator housing 106 and switch housing 112 are moved toward, and are within a first predetermined distance of, each other. The magnetically operated switch circuits 116 are additionally configured to transition between the switch positions when the actuator housing 106 and switch housing 112 are moved away from, and are at least a second predetermined distance from, each other.

Figure 2:
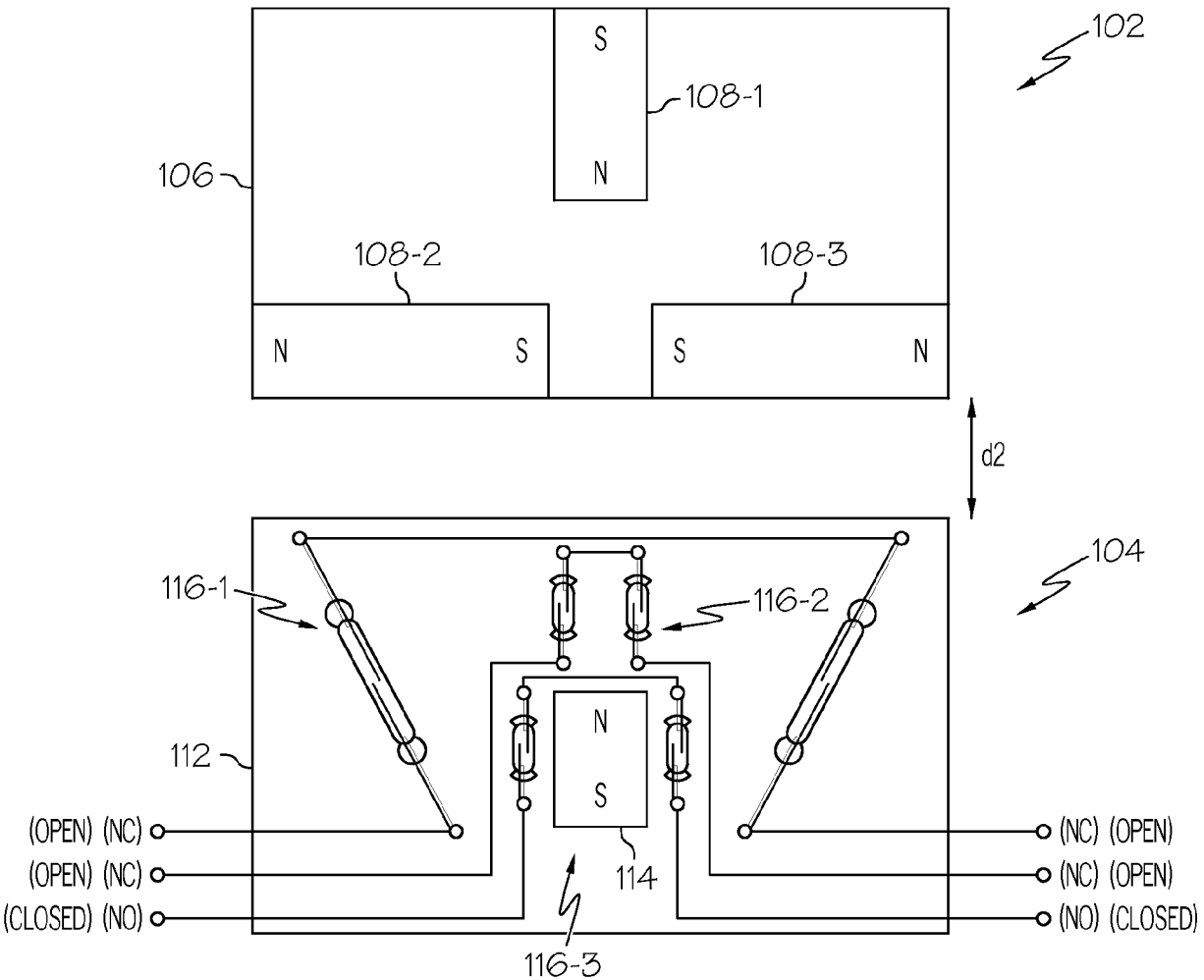
FIG. 2 depicts a functional schematic diagram of the quadrupole magnetic coded switch of FIG. 1 in a second state.

It is noted that in the particular embodiment depicted in FIGS. 1 and 2, in which the plurality of switch positions include an open position and a closed position, when the actuator housing 106 and the switch housing 112 are moving toward, and are within the first predetermined distance (d1) of, each other, a first subset of the magnetically operated switch circuits 116 transitions from an open position to a closed position, and a second subset of the magnetically operated switch circuits 116 transitions from closed position to an open position. Conversely, when the actuator housing 106 is moved away from, and is the second predetermined distance (d2) from, the switch housing 112, then the first subset of magnetically operated switch circuits 116 transitions back to the open position, and the second subset of magnetically operated switch circuits 116 transitions back to the closed position. Although the number of magnetically operated switches that comprise each subset may vary, in the depicted embodiment the first subset comprises a two magnetically operated switch circuits 116-1, 116-2, and the second subset comprises one magnetically operated switch circuit 116-3.

Before proceeding further, it is noted that the terms normally closed (NC) and normally open (NO), as used herein, are associated with a magnetically operated switch circuit 116 when the actuator housing 106 is within the first predetermined distance (d1) of the switch housing 112. It will thus be appreciated that, in using this convention, magnetically operated switch circuits 116-1, 116-2 are both NC switch circuits and magnetically operated switch circuit 116-3 is a NO switch circuit.

Preferably, the actuator assembly 102 is movable relative to the switch assembly 104. Thus, in most embodiments the actuator housing 106 is coupled to a movable portion of a particular device, system, or machine such as, for example, a machine guard, a door, or any one of numerous other movable portions. Concomitantly, the switch housing 112 is preferably coupled to a stationary portion of the same particular device, system, or machine as the actuator housing 106. Moreover, an electrical potential is preferably applied across the magnetically operated switch circuits 116. Thus, when the magnetically operated switch circuits 116 are in the open state, electrical current will not flow through the magnetically operated switch circuits 116, whereas in the closed state, electrical current will flow through the magnetically operated switch circuits 116.

Figure 3:
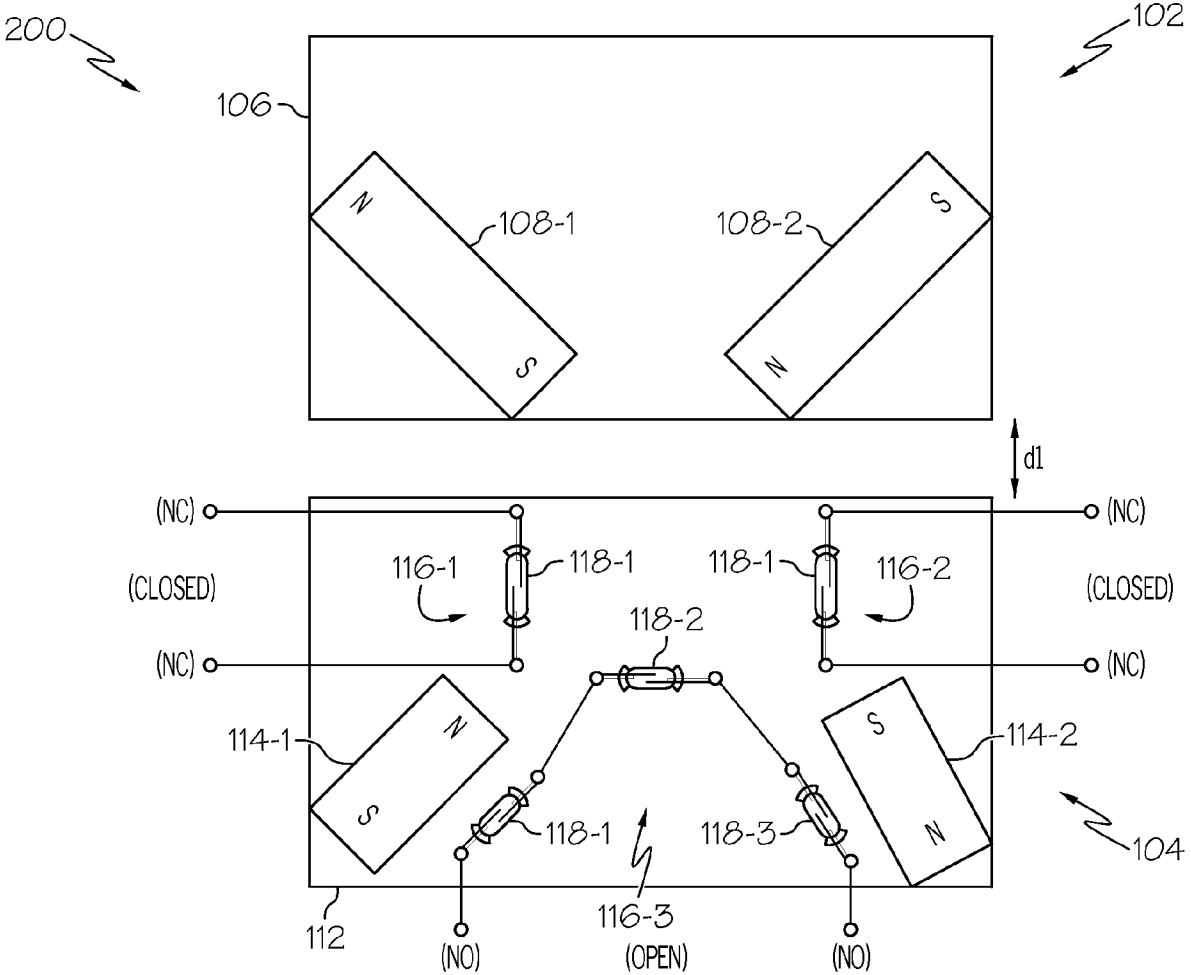
FIG. 3 depicts a functional schematic diagram of a second embodiment of a quadrupole magnetic coded switch in a first state.
Figure 4:
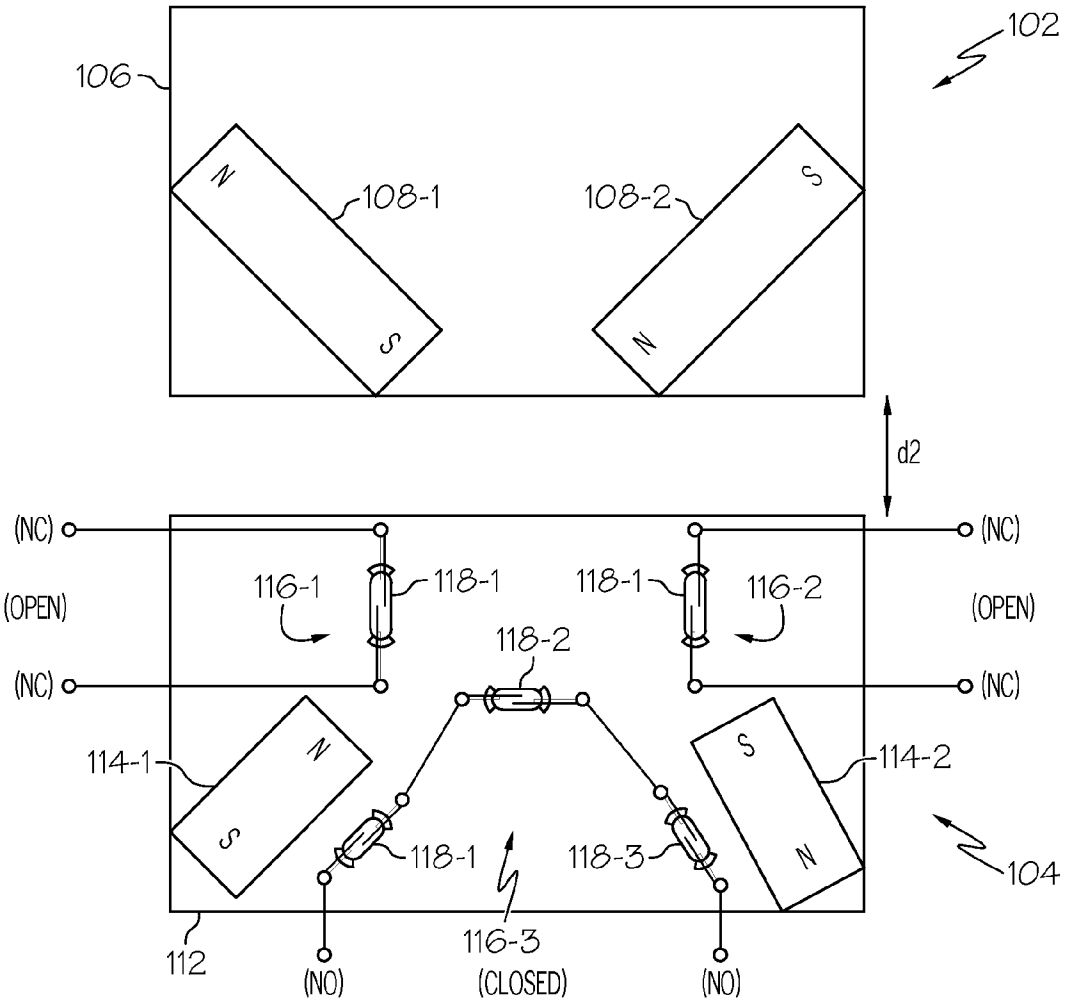
FIG. 4 depicts a functional schematic diagram of the quadrupole magnetic coded switch of FIG. 3 in a second state.
Figure 5:
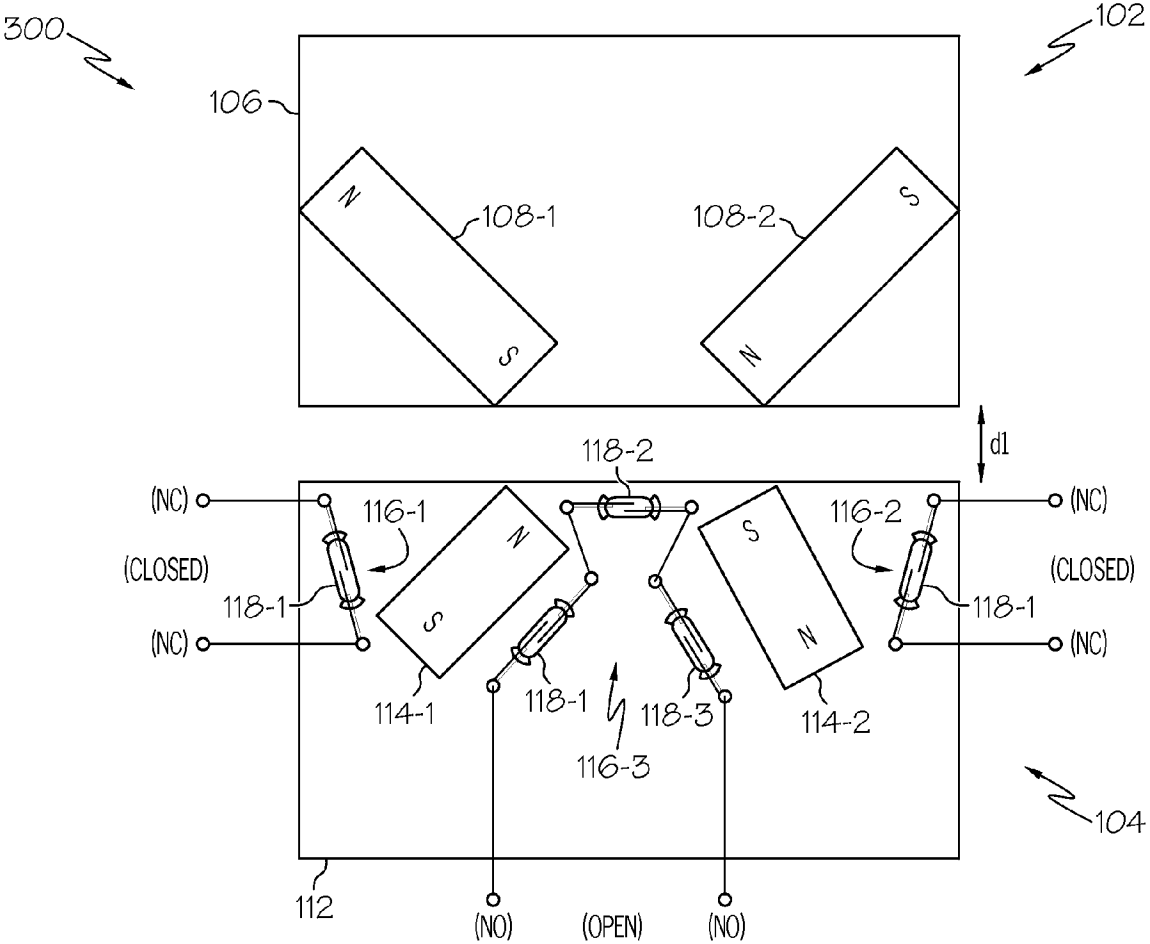
FIG. 5 depicts a functional schematic diagram of a third embodiment of a quadrupole magnetic coded switch in a first state.
Figure 6:
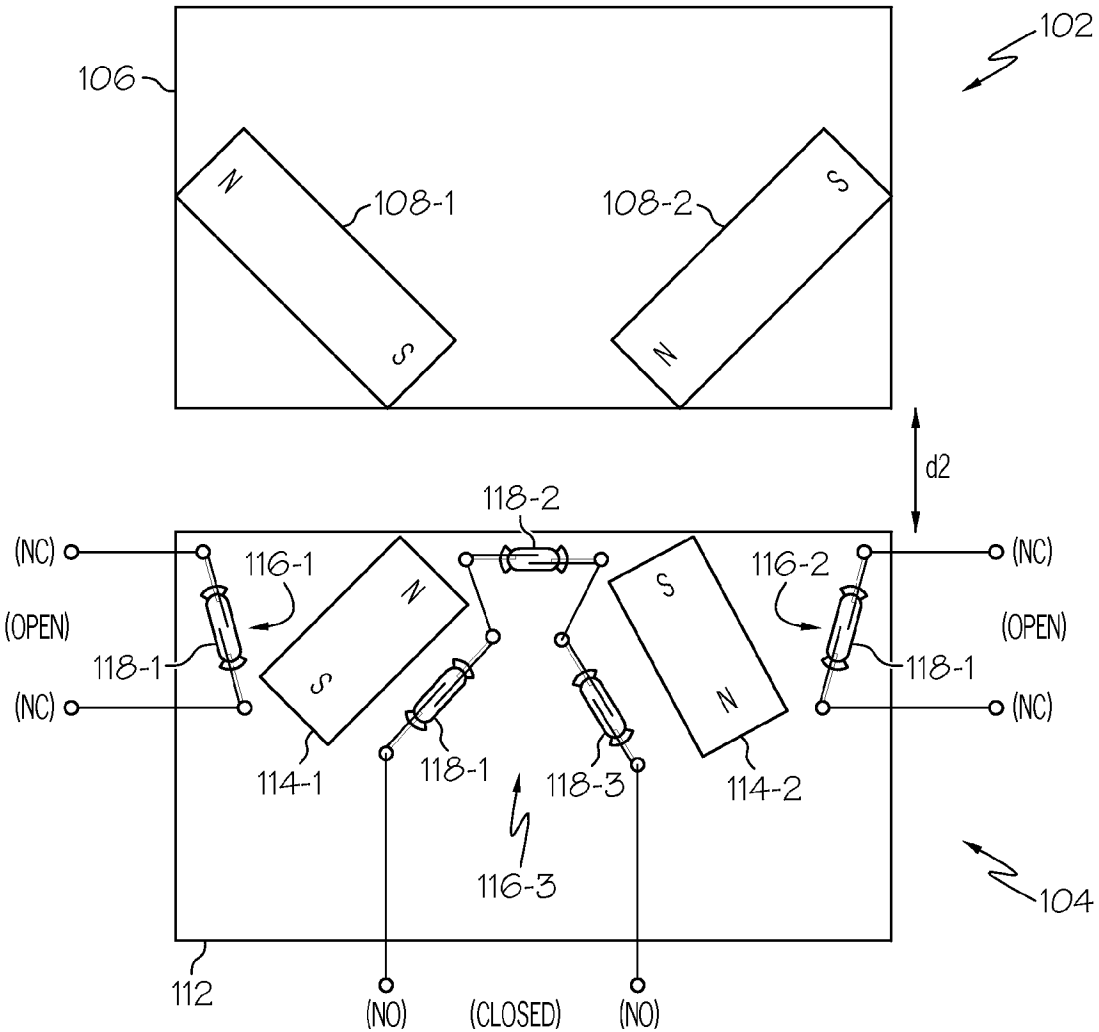
FIG. 6 depicts a functional schematic diagram of the quadrupole magnetic coded switch of FIG. 5 in a second state.

It was noted above that the configuration and number of actuator dipole magnets 108 and switch dipole magnets 114 may vary. It was additionally noted that the specific number of sets of switch contacts 118 that comprise each of the magnetically operated switch circuits 116 may vary. For example, in two exemplary alternative embodiments, one of which is depicted in FIGS. 3 and 4, and another of which is depicted in FIGS. 5 and 6, the actuator assembly 102 and switch assembly 104 both include two magnets, and thus two magnetic pole pairs. Moreover, in both of these alternative embodiments the NO magnetically operated switch circuit 116-3 is implemented using three sets of switch contacts 118-1, 118-2, 118-3, while the NC magnetically operated switch circuits 116-1, 116-2 are each implemented using one set switch of contacts 118. The relative disposition of the magnetically operated switches 116, the actuator dipole magnets 108, and the switch dipole magnets 114 differs in each of the embodiments. However, the overall function of each switch 200, 300 remains the same.

Figure 7:
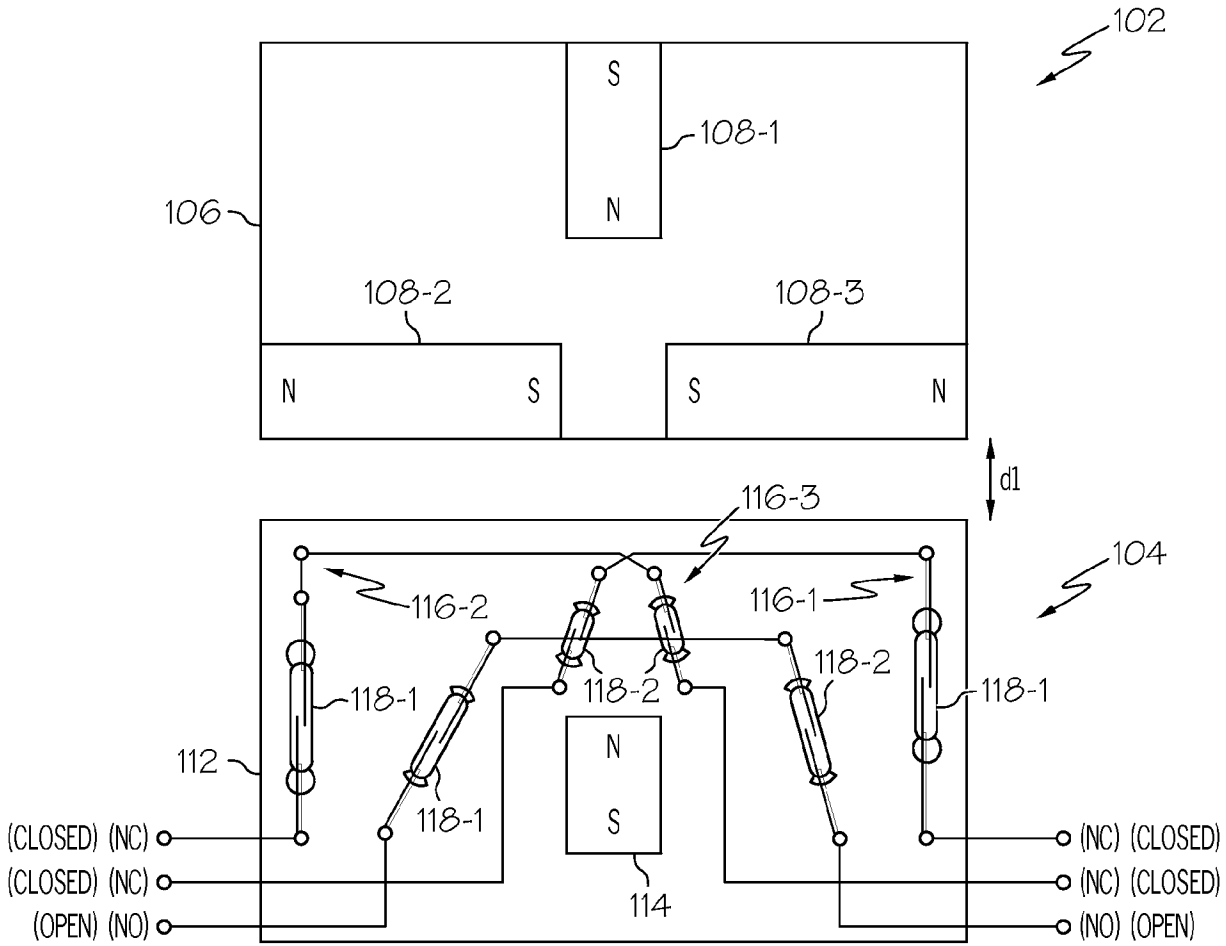
FIG. 7 depicts a functional schematic diagram of a fourth embodiment of a quadrupole magnetic coded switch in a first state.
Figure 8:
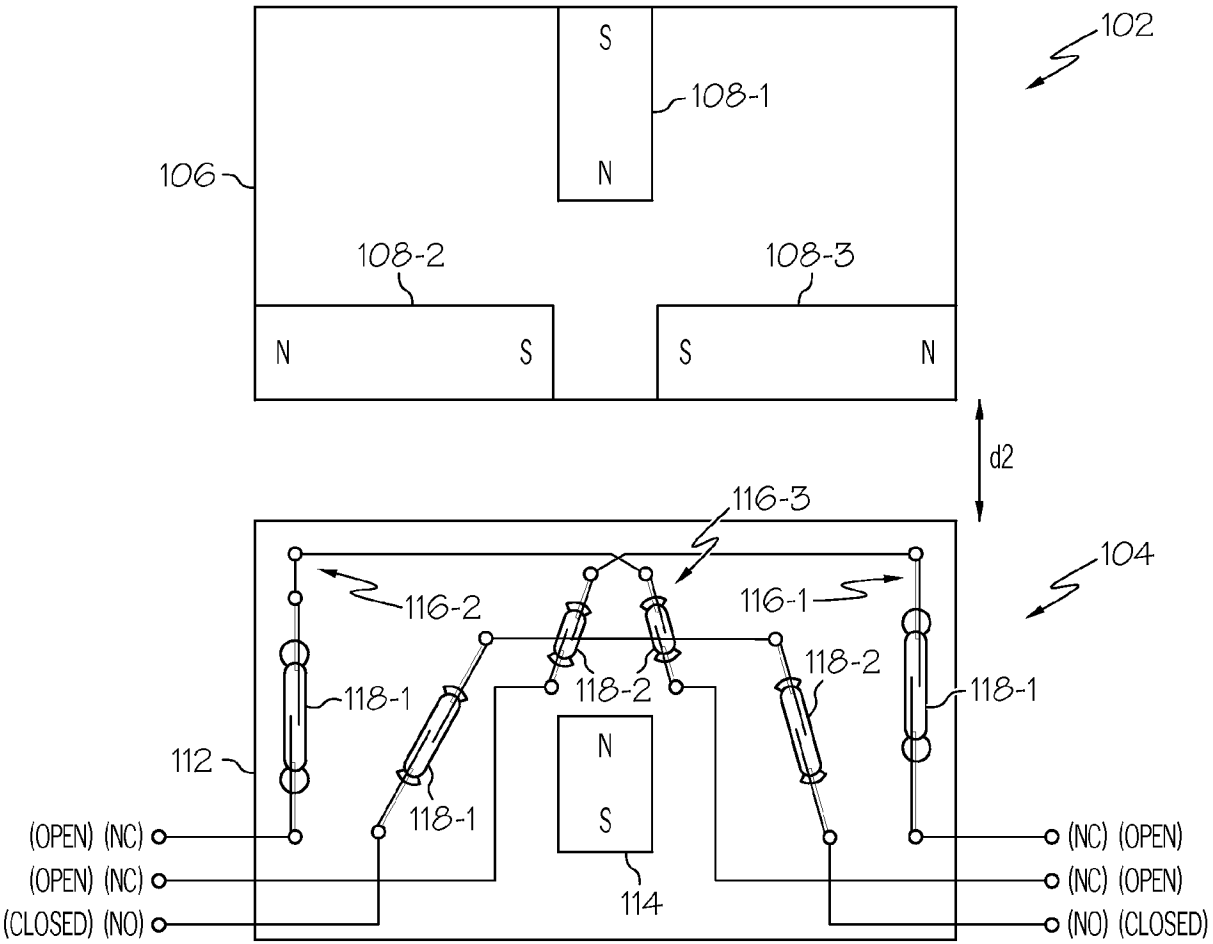
FIG. 8 depicts a functional schematic diagram of the quadrupole magnetic coded switch of FIG. 7 in a second state.

In addition to configuration and numerical variations described above and depicted in FIGS. 3-6, the specific configuration of the magnetically operated switch circuits 116 may also vary. One example of such a variation is depicted in FIGS. 7 and 8. In this embodiment, the relative disposition of the actuator dipole magnets 108 and the switch dipole magnets 114 is similar to the embodiment depicted in FIG. 1. The configuration of the magnetically operated switch circuits 116 is, however, different. Nonetheless, the overall function of the switch 400 depicted in FIGS. 7 and 8 is the same as the switch 100 depicted in FIGS. 1 and 2.

Not only may the configuration and number of actuator magnets 108, switch magnets 114, and magnetically operated switch circuits 116 within individual quadrupole magnetic coded switches vary, but the number of quadrupole magnetic coded switches that are used may vary. For example, a device, system, or machine may include two or more the quadrupole magnetic coded switches, some or all of which may or may not be electrically connected together.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention.

What is claimed is:

1. A quadrupole magnetic coded switch, comprising:

a switch housing;

an actuator housing movable relative to the switch housing;

a plurality of actuator dipole magnets coupled to the actuator housing and movable therewith;

one or more switch dipole magnets coupled to the switch housing, the one or more switch dipole magnets and the plurality of actuator dipole magnets arranged to generate a quadrupole magnetic field; and a plurality of magnetically operated switch circuits, each magnetically operated switch circuit disposed within the switch housing and configured to transition between a plurality of switch positions in response to relative movement of the actuator housing and the switch housing, each magnetically operated switch circuit is configured to transition between the two switch positions when (i) the actuator housing and switch housing are moved toward, and are within a first predetermined distance of, each other and (ii) the actuator housing and switch housing are moved away from, and are at least a second predetermined distance from, each other, wherein the first predetermined distance is less than the second predetermined distance.

2. The quadrupole magnetic coded switch of claim 1, wherein the two switch positions include a closed position and an open position.

3. The quadrupole magnetic coded switch of claim 2, wherein, when the actuator housing and switch housing are moved toward, and are within the first predetermined distance of, each other:

a first subset of the plurality of magnetically operated switch circuits transitions from the open position to the closed position; and a second subset of the plurality of magnetically operated switch circuits transitions from the closed position to the open position.

4. The quadrupole magnetic coded switch of claim 3, wherein, when the actuator housing and switch housing are moved away from, and are at least the second predetermined distance from, each other:

the first subset of the plurality of magnetically operated switch circuits transitions from the closed position to the open position; and the second subset of the plurality of magnetically operated switch circuits transitions from the open position to the closed position.

5. The quadrupole magnetic coded switch of claim 1, wherein:

the plurality of actuator dipole magnets comprises three dipole magnets; and the one or more switch dipole magnets comprises one dipole magnet.

6. The quadrupole magnetic coded switch of claim 1, wherein:

the plurality of actuator dipole magnets comprises two dipole magnets; and the one or more switch dipole magnets comprises two dipole magnets.

7. The quadrupole magnetic coded switch of claim 1, wherein at least one of the plurality of magnetically operated switch circuits comprises a plurality of sets of magnetically operated switch contacts electrically connected in series.

8. The quadrupole magnetic coded switch of claim 1, wherein each of the plurality of magnetically operated switch circuits comprises a plurality of sets of magnetically operated switch contacts electrically connected in series.

9. A quadrupole magnetic coded switch, comprising:

a switch housing;

an actuator housing movable relative to the switch housing;

a plurality of actuator dipole magnets coupled to the actuator housing and movable therewith;

one or more switch dipole magnets coupled to the switch housing, the one or more switch dipole magnets and the plurality of actuator dipole magnets arranged to generate a quadrupole magnetic field; and a plurality of reed switches, each reed switch disposed within the switch housing and configured to transition between a plurality of switch positions in response to relative movement of the actuator housing and the switch housing, wherein each reed switch transitions between the two switch positions when (i) the actuator housing and switch housing are moved toward, and are within a first predetermined distance of, each other, and (ii) the actuator housing and switch housing are moved away from, and are at least a second predetermined distance from, each other, wherein the first predetermined distance is less than the second predetermined distance.

10. The quadrupole magnetic coded switch of claim 9, wherein the two switch positions include a closed position and an open position.

11. The quadrupole magnetic coded switch of claim 10, wherein, when the actuator housing and switch housing are moved toward, and are within the first predetermined distance of, each other:

a first subset of the plurality of reed switches transitions from the open position to the closed position; and a second subset of the plurality of reed switches transitions from the closed position to the open position.

12. The quadrupole magnetic coded switch of claim 11, wherein, when the actuator housing and switch housing are moved away from, and are at least the second predetermined distance from, each other:

the first subset of the plurality of reed switches transitions from the closed position to the open position; and the second subset of the plurality of reed switches transitions from the open position to the closed position.

13. The quadrupole magnetic coded switch of claim 9, wherein:

the plurality of actuator dipole magnets comprises three dipole magnets; and the one or more switch dipole magnets comprises one dipole magnet.

14. The quadrupole magnetic coded switch of claim 9, wherein:

the plurality of actuator dipole magnets comprises two dipole magnets; and the one or more switch dipole magnets comprises two dipole magnets.

15. A quadrupole magnetic coded switch, comprising:

a switch housing;

an actuator housing movable relative to the switch housing;

a plurality of actuator dipole magnets coupled to the actuator housing and movable therewith;

one or more switch dipole magnets coupled to the switch housing, the one or more switch dipole magnets and the plurality of actuator dipole magnets arranged to generate a quadrupole magnetic field; and a magnetically operated switch circuit disposed within the switch housing and configured to move (i) from an open position to a closed position when the actuator housing and switch housing are moved toward, and are within a first predetermined distance of, each other, and (ii) from the closed position to the open position when the actuator housing and switch housing are the moved away from, and are at least a second predetermined distance from, each other, wherein the first predetermined distance is less than the second predetermined distance.

16. The quadrupole magnetic coded switch of claim 15, further comprising:

a second magnetically operated switch circuit disposed within the switch housing, the second magnetically operated switch circuit configured to move from (i) an open position to a closed position when the actuator housing and switch housing are moved toward, and are within the first predetermined distance of, each other, and (ii) from the closed position to the open position when the actuator housing and switch housing are the moved away from, and are at least the second predetermined distance from, each other.

17. The quadrupole magnetic coded switch of claim 16, further comprising:

a third magnetically operated switch circuit disposed within the switch housing, the third magnetically operated switch circuit configured to move from (i) a closed position to an open position when the actuator housing and switch housing are moved toward, and are within the first predetermined distance of, each other, and (ii) from the open position to the closed position when the actuator housing and switch housing are the moved away from, and are at least the second predetermined distance from, each other.

* * * * *